US005993183A

United States Patent [19]

Laskaris et al.

[11] Patent Number: 5,993,183

[45] Date of Patent: Nov. 30, 1999

[54] GEAR COATINGS FOR ROTARY GEAR PUMPS

[75] Inventors: Michael A. Laskaris, Collegeville; Frank C. Keirsey, Jr., Bridgeport, both of Pa.

[73] Assignee: Hale Fire Pump Co., Conshohocken, Pa.

[21] Appl. No.: 08/927,798

[22] Filed: Sep. 11, 1997

[51] Int. Cl.[6] ..... F04C 2/18; F04C 13/00

[52] U.S. Cl. ..... 418/178; 418/179; 418/206.9; 29/888.023

[58] Field of Search ..... 418/178, 179, 418/206.9; 29/888.023

[56] References Cited

U.S. PATENT DOCUMENTS

| | | | |
|---|---|---|---|
| 2,966,860 | 1/1961 | Maynard | 418/178 |
| 3,918,137 | 11/1975 | Telang et al. | 418/178 |
| 4,682,939 | 7/1987 | Petro | 418/178 |
| 4,974,318 | 12/1990 | Heppekausen et al. | 418/178 |
| 5,024,591 | 6/1991 | Nakajima | 418/179 |
| 5,060,531 | 10/1991 | Iguchi et al. | 418/178 |
| 5,554,020 | 9/1996 | Rao et al. | 418/178 |

*Primary Examiner*—John J. Vrablik
*Attorney, Agent, or Firm*—Hill & Simpson

[57] ABSTRACT

Gears for pumping non-lubricating fluids at high pressure are provided which include special coatings. One of the gears is coated with a combination of nickel and polytetrafluoroethylene; the other gear is coated with a combination of carbon and tungsten carbide. Because the coatings are different and have different hardnesses, galling is prevented. Preferably, the gears are fabricated from stainless steel and, therefore, in the event a scratch or nick in the coating is produced, corrosion is prevented. The gears are useful for gear pumps used to pump fire fighting liquids and foam at high pressures.

20 Claims, 1 Drawing Sheet

GEAR COATINGS FOR ROTARY GEAR PUMPS

BACKGROUND OF THE INVENTION

The present invention relates to pumps. More specifically, the present invention relates to rotary gear pumps and, still more specifically, the present invention relates to coatings for gears used in rotary gear pumps that provide wear resistance and lubrication properties to the gears.

Gear pumps typically utilize two gears. One gear is referred to as the driver and is connected to the input power shaft. The other gear is referred to as an idler gear and rotates with the driver gear. In most gear pumps, the two gears mesh, i.e. then engage one another. Accordingly, lubrication and wear can pose serious problems that affect the performance of the pump and the frequency in which the gears must be changed.

Further, gear pumps are typically used to pump fire fighting foam. These pumps must operate at pressures ranging from 100 psig to 400 psig. While these pressures are not ordinarily problematic with hydraulic gear pumps that pump oil, hydraulic fluid or some other lubricating fluid, these pressures are particularly problematic with pumps that pump fire fighting foam chemicals because the foam chemicals are not good lubricants. Some fire fighting foams are fabricated from animal matter and can have abrasive bits of bone and other impurities that can increase the wear of the gears. Other synthetic foams can be very thin and therefore unable to support a hydrodynamic film that acts as a lubricant on the exterior of the gear. While a foam material can appear thick when contained in a vessel, foams can be extremely watery and thin as the foam is sheared inside a pump chamber under the action of two rotating gears. Some foam chemicals are thixotropic, and become extremely low viscosity when sheared while maintaining high viscosity while at rest.

Still further, fire fighting foams and chemicals can be corrosive. Aqueous solutions will rust ordinary carbon steels and therefore the use of bronze or 300 series stainless steels are required to combat corrosion. However, these materials do not wear very well and have a tendency to gall. Accordingly, bronze and stainless steel gears wear our prematurely and are not preferred materials for use at high pressures.

One solution to the aforenoted problems has been the development of pumps with external gear timing. Specifically, the rotation of the two gears is timed in such a way so as to actually prevent the gear teeth from engaging one another and therefore imposing wear upon one another. However, the external timing gears must be disposed in oil and sealed from the pump chamber containing the pump gears. Because of the high pressures involved in pumping fire fighting chemicals and foam, additional shaft seals, an oil bath housing and other miscellaneous parts are required to isolate the timing gears from the high pressure environment of the pump chamber and pump gears. As a result, gear pumps that employ external gear timing are complex and costly. Further, the numerous potential leak points inherent in these designs create additional maintenance problems.

As a result, there is a need for an improved rotary gear pump having improved gears that wear longer and resist galling to a greater extent than currently available rotary gears. Additionally, there is a need for an improved rotary gear pump that can operate dependably at high pressures for extended periods of time without the need for resorting to an external gear timing design.

SUMMARY OF THE INVENTION

The present invention satisfies the aforenoted needs by providing a rotary gear that has two gears, each gear having a different coating. The first gear is coated with a mixture of nickel and polytetrafluoroethylene while the second gear is coated with a mixture of carbon and tungsten carbide.

In an embodiment, the coating on the first gear is further characterized as comprising from about 60% to about 80% by weight nickel and from about 40% to about 20% by weight polytetrafluoroethylene.

In an embodiment, the first coating is further characterized as comprising from about 70% to about 90% by weight nickel and from about 30% to about 10% by weight polytetrafluoroethylene.

In an embodiment, the first coating is further characterized as comprising from about 80% by weight nickel and about 20% by weight polytetrafluoroethylene.

In an embodiment, the second coating is further characterized as comprising from about 65% to about 100% by weight carbon and from about 35% to about 0% by weight tungsten carbide.

In an embodiment, the second coating is further characterized as comprising from about 75% to about 95% by weight carbon and from about 25% to about 5% by weight tungsten carbide.

In an embodiment, the second coating is further characterized as comprising about 85% by weight carbon and about 15% by weight tungsten carbide. In an embodiment, the first and second gears are fabricated from 17-4 PH stainless steel.

In an embodiment, the first and second gears are fabricated from 17-4 PH stainless steel that has a toughness condition of H900.

In an embodiment, the nickel component of the first coating has an apparent hardness of 55 Rc.

In an embodiment, the tungsten carbide component of the second coating has an apparent hardness of 75 Rc.

In an embodiment, the present invention provides a method of manufacturing spur gears for foam pumps, the method comprises the steps of manufacturing a first gear from stainless steel and manufacturing a second gear from stainless steel followed by the steps of coating the first gear with a first coating comprising a mixture of nickel and polytetrafluoroethylene and coating the second gear with a second coating comprising a mixture of carbon and tungsten carbide.

It is therefore an advantage of the present invention to provide spur gears having improved wearability.

Another advantage of the present invention is that it provides spur gears having improved lubrication qualities.

Yet another advantage of the present invention is that it provides spur gears fabricated from the same material without a tendency to gall.

Another advantage of the present invention is that it provides improved coatings for spur gears.

Still another advantage of the present invention is that it provides an improved method of manufacturing spur gears for use in rotary gear pumps.

Yet another advantage of the present invention is that it provides an improved rotary gear pump design for use at high pressures.

And another advantage of the present invention is that it provides an improved rotary gear pump design for pumping fire fighting chemicals and fire fighting foam at high pressures.

Other objects and advantages of the present invention will become apparent upon reading the following detailed description and appended claims, and upon reference to the accompanying drawings.

BRIEF DESCRIPTION OF THE DRAWINGS

For a more complete understanding of the present invention, reference should now be made to the embodiments illustrated in greater detail in the accompanying drawings and described below by way of an example of the present invention.

In the drawings.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
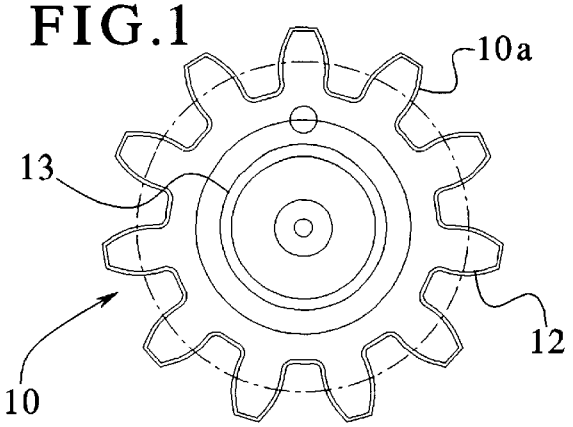
FIG. 1 is an end view of a spur gear made in accordance with the present invention.
Figure 3:
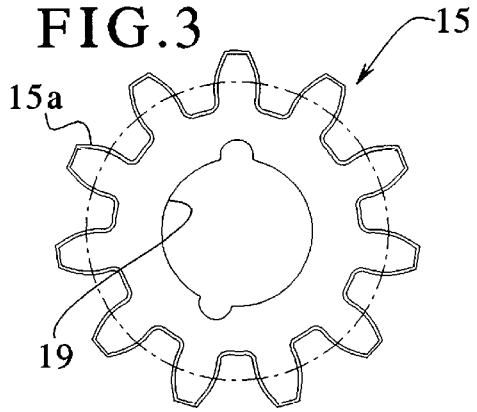
FIG. 3 is an end view of a spur gear made in accordance with the present invention that is intended to be mounted onto a drive shaft (not shown)
Figure 2:
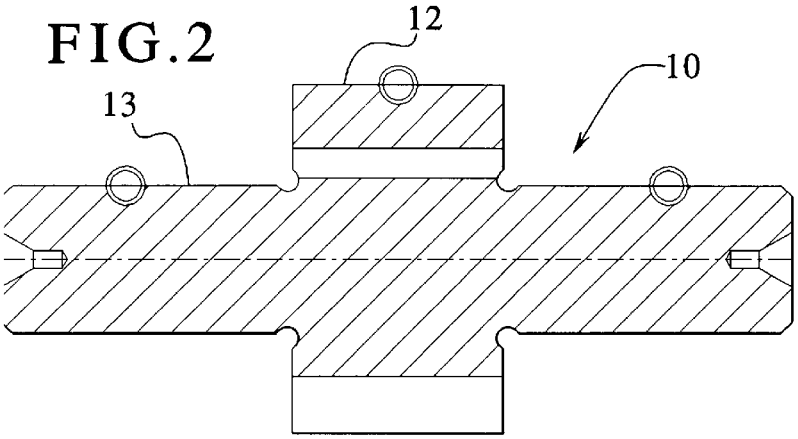
FIG. 2 is a side elevational view of the spur gear first illustrated in FIG. 1.
Figure 4:
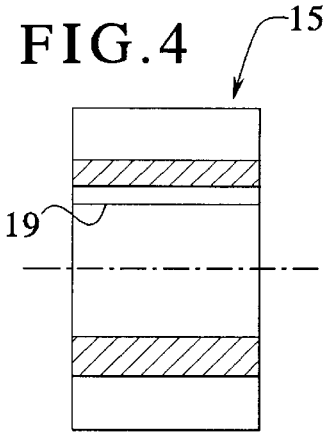
FIG. 4 is a side elevational view of the spur gear shown in FIG. 3.
Figure 5:
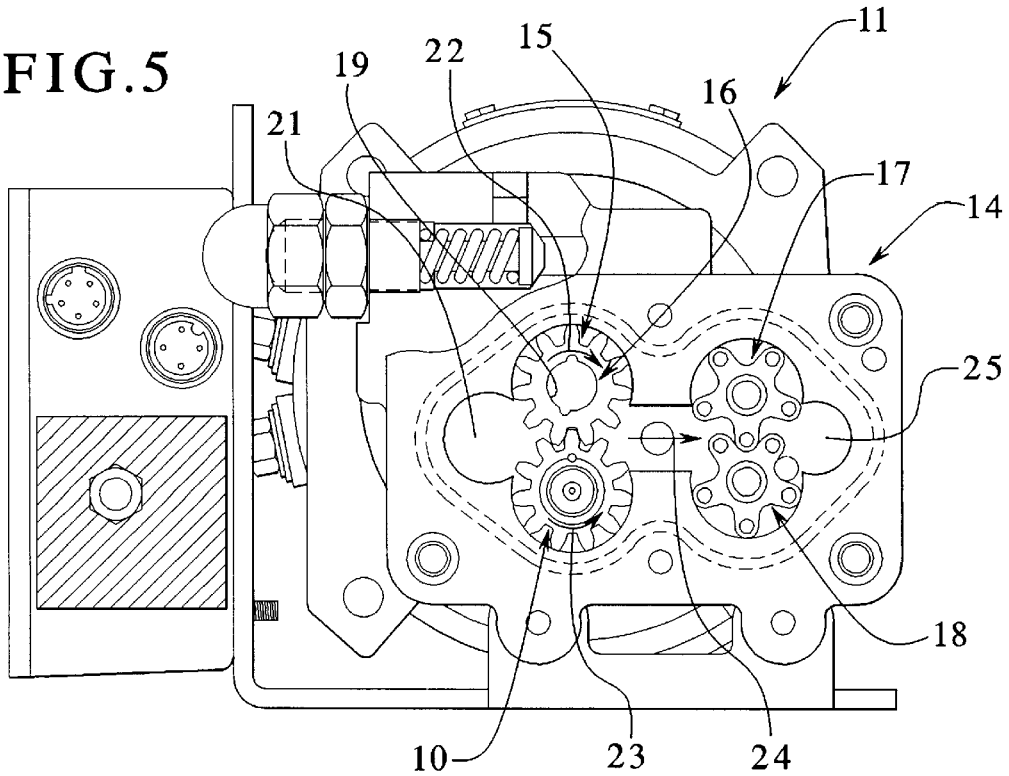
FIG. 5 is a cross sectional view of a rotary gear pump that includes spur gears made in accordance with the present invention.

FIG. 1 illustrates a spur-type gear 10 that can serve as an idler gear for use in a rotary gear pump such as that shown at 11 in FIG. 5. The gear 10 includes a plurality of spurs or teeth 12 and a centrally disposed shaft portion 13 which is disposed inside the walls of the pump chamber 14 (see FIG. 5). In contrast to the idler gear 10 illustrated in FIGS. 1 and 2, the pump 11 also includes a driver gear 15 as shown in FIGS. 3 and 4, which is mounted onto a drive shaft 16. Thus, the driver gear 15 does not include an integrally connected central shaft portion 13 as is incorporated into the idler gear 10 but, instead, includes a central passageway 19 for accommodating the drive shaft 16.

Still referring to FIG. 5, the stationary casing 14 of the pump 11 also accommodates two flow meter gears 17, 18. The material to be pumped, in this case a fire fighting foam, enters through an inlet 21, is pumped in the direction of the arrows 22, 23 and then flows in the direction of the arrow 24 before passing through the flow meter gears 17, 18. The outlet is indicated at 25.

The design of the gears 10, 15 may be conventional or preferably utilize long addendums for better contact ratio and efficiency. In a preferred embodiment, the gears are machined or molded from a 17-4 PH stainless steel provided in a H900 condition for toughness. The pump gears of the present invention may be machined but they can also be molded using powder metallurgy techniques. Other hardnesses are also feasible but must be above $Rc^{32}$ or gears will still wear. Each gear 10, 15 is further coated with a different coating 10*a*, 15*a* (see FIGS. 1 and 3 respectively). One of the gears, either 10 or 15, pursuant to the present invention, may be coated with a mixture of nickel and TEFLON®. In order to achieve the desired durability, the mixture should comprise greater than 50% nickel, preferably between 60% nickel and 100% nickel, still more preferably, between 70% and 90% nickel and most preferably about 80% nickel. In order to achieve the desired lubrication characteristics, the mixture should comprise at least some TEFLON®, preferably between 0% and 40% TEFLON®, more preferably between 10% and 30% TEFLON® and most preferably about 20% TEFLON®.

In order to achieve the required gall resistance, the second coating should comprise materials different from the first coating. In an embodiment, the second coating comprises carbon and tungsten carbide. In order to achieve the desired lubrication characteristics, the second coating should comprise carbon in an amount ranging from about 65% to about 100% by weight carbon, more preferably from about 75% to about 95% by weight carbon and most preferably about 85% by weight carbon. In order to achieve the desired hardness characteristics, the second coating should comprise from about 35% to about 0% by weight tungsten carbide, more preferably from about 25% to about 5% by weight tungsten carbide and most preferably about 15% by weight tungsten carbide.

A nickel/TEFLON® coating suitable for use with the present invention can be obtained from Nutmeg Chrome Corporation of West Hartford, Conn. The nickel and TEFLON® are co-deposited by providing the TEFLON® in small particle sizes, of approximately 0.25 microns. The TEFLON® is dispersed throughout the nickel and the two components are deposited by an electroless technique. In contrast, the tungsten carbide/carbon coating is applied using a sputter assisted CVD. The components for the tungsten carbide/carbon coating can be obtained from Balzers Tool Coating, Inc. of Amherst, N.Y.

In a preferred embodiment, both the gears 10 and 15 are fabricated from 17-4 pH stainless steel. If the coatings are compromised by a scratch or wear, the 17-4 pH stainless steel will not corrode. It should also be noted that tungsten carbide is harder than electroless nickel and therefore the second coating is harder than the first coating which helps reduce any tendency for galling between the two gears 10, 15.

From the above description, it is apparent that the objects and advantages of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. A pump comprising:

a first gear and a second gear, the first gear being coated with a first coating comprising nickel and polytetrafluoroethylene, the second gear being coated with a second coating comprising carbon and tungsten carbide.

2. The pump of claim 1 wherein the first coating is further characterized as comprising from about 60% to about 100% by weight nickel and from about 40% to about 0% by weight polytetrafluoroethylene.

3. The pump of claim 1 wherein the first coating is further characterized as comprising from about 70% to about 90% by weight nickel and from about 30% to about 10% by weight polytetrafluoroethylene.

4. The pump of claim 1 wherein the first coating is further characterized as comprising about 80% by weight nickel and about 20% by weight polytetrafluoroethylene.

5. The pump of claim 1 wherein the second coating is further characterized as comprising from about 65% to about 100% by weight carbon and from about 35% to about 0% by weight tungsten carbide.

6. The pump of claim 1 wherein the second coating is further characterized as comprising from about 75% to about 95% by weight carbon and from about 25% to about 5% by weight tungsten carbide.

7. The pump of claim 1 wherein the second coating is further characterized as comprising about 85% by weight carbon and about 15% by weight tungsten carbide.

8. The pump of claim 1 wherein the first coating is further characterized as comprising from about 60% to about 100% by weight nickel and from about 40% to about 0% by weight polytetrafluoroethylene, and wherein the second coating is further characterized as comprising from about 65% to about 100% by weight carbon and from about 35% to about 0% by weight tungsten carbide.

9. The pump of claim 1 wherein the first coating is further characterized as comprising from about 70% to about 90% by weight nickel and from about 30% to about 10% by weight polytetrafluoroethylene, and wherein the second coating is further characterized as comprising from about 75% to about 95% by weight carbon and from about 25% to about 5% by weight tungsten carbide.

10. The pump of claim 1 wherein the first coating is further characterized as comprising about 80% by weight nickel and about 20% by weight polytetrafluoroethylene, and wherein the second coating is further characterized as comprising about 85% by weight carbon and about 15% by weight tungsten carbide.

11. The pump of claim 1 wherein the first and second gears are fabricated from 17-4 PH stainless steel.

12. The pump of claim 11 wherein the 17-4 PH stainless steel has a toughness condition of H900.

13. The pump of claim 1 wherein the nickel has an apparent hardness of 55 Rc.

14. The pump of claim 1 wherein the tungsten carbide has an apparent hardness of 75 Rc.

15. A gear pump for pumping foam, the pump comprising:

a first spur gear connected to a drive shaft and a second spur gear that serves as an idler, the first and second gears being manufactured from the same material, the first and second gears being coated with different materials, the first spur gear being coated with a first coating comprising nickel and polytetrafluoroethylene, the second spur gear being coated with a second coating comprising carbon and tungsten carbide.

16. The pump of claim 15 wherein thee first coating is further characterized as comprising from about 70% to about 90% by weight nickel and from about 30% to about 10% by weight polytetrafluoroethylene, and wherein the second coating is further characterized as comprising from about 65% to about 100% by weight carbon and from about 35% to about 0% by weight tungsten carbide.

17. A gear pump for pumping foam, the pump comprising:

a first spur gear serving as an idler and a second spur gear that is connected to a drive shaft, the first and second gears being manufactured from the same material, the first and second gears being coated with different materials, the first spur gear being coated with a first coating comprising nickel and polytetrafluoroethylene, the second spur gear being coated with a second coating comprising carbon and tungsten carbide.

18. The pump of claim 15 wherein thee first coating is further characterized as comprising from about 70% to about 90% by weight nickel and from about 30% to about 10% by weight polytetrafluoroethylene, and wherein the second coating is further characterized as comprising from about 65% to about 100% by weight carbon and from about 35% to about 0% by weight tungsten carbide.

19. A method of manufacturing spur gears for foam pumps, the method comprising:

manufacturing a first spur gear from stainless steel;

manufacturing a second spur gear from stainless steel;

coating the first gear with a first coating comprising a mixture of nickel and polytetrafluoroethylene;

coating the second gear with a second coating comprising a mixture of carbon and tungsten carbide.

20. The method of claim 19 wherein the first coating is further characterized as comprising about 80% by weight nickel and about 20% by weight polytetrafluoroethylene, and wherein the second coating is further characterized as comprising about 85% by weight carbon and about 15% by weight tungsten carbide.

* * * * *